US005435464A

United States Patent [19]

Alexander et al.

[11] Patent Number: 5,435,464

[45] Date of Patent: Jul. 25, 1995

[54] SYSTEM FOR THE PREVENTION OF THE JAMMING OF PUMPS

[75] Inventors: Rex Alexander, Hurricane, W. Va.; Dale J. Hikes, Gettysburg, Pa.

[73] Assignee: Mobil Oil Corporation, Fairfax, Va.

[21] Appl. No.: 243,899

[22] Filed: May 17, 1994

[51] Int. Cl.[6] ..... B67D 5/60

[52] U.S. Cl. ..... 222/105; 222/382; 222/464.3

[58] Field of Search ..... 222/105, 183, 211, 382, 222/464

[56] References Cited

U.S. PATENT DOCUMENTS

| | | | |
|---|---|---|---|
| 1,945,824 | 2/1934 | Saxe | 210/170 |
| 2,082,706 | 6/1937 | Maggiora | 222/464 X |
| 2,300,952 | 11/1942 | May | 210/170 |
| 3,674,179 | 7/1972 | Galloway | 222/464 X |
| 4,187,959 | 2/1980 | Pelton | 222/382 X |
| 4,193,520 | 3/1980 | Duffield | 222/464 X |
| 4,245,760 | 1/1981 | Stevenson et al. | 222/464 X |
| 4,273,272 | 6/1981 | Blanc | 222/464 |
| 4,505,138 | 3/1985 | Lang | 68/208 |
| 4,548,344 | 10/1985 | Hestehave et al. | 222/464 |
| 4,570,833 | 2/1986 | Vanderjagt | 222/382 X |
| 4,630,759 | 12/1986 | Dawn | 222/382 X |
| 4,832,237 | 5/1989 | Hurford, Jr. | 222/464 |
| 5,186,365 | 2/1993 | Nolte | 222/464 X |
| 5,376,272 | 12/1994 | Spearman | 222/464 X |

*Primary Examiner*—Kevin P. Shaver
*Attorney, Agent, or Firm*—Alexander J. McKillop; George W. Hager; Clinton H. Hallman, Jr.

[57] ABSTRACT

A system for the prevention of jamming of pumps used with containers having a liner therein. The system includes a container having a disposable liner contained therein, a pump and a housing attached to the lower end of the pump. The housing has at least one downwardly extending leg which serves to hold down the disposable liner thereby preventing the pump from being clogged or damaged by pieces of the flexible liner. The housing also has at least one passage therethrough to allow the flow of the medium being pumped upwardly through the housing central cavity. The invention is particularly adapted to the pumping of grease.

9 Claims, 5 Drawing Sheets

SYSTEM FOR THE PREVENTION OF THE JAMMING OF PUMPS

FIELD OF THE INVENTION

The present invention relates to a system for the prevention of the jamming of pumps by pieces of a plastic liner used inside the containers of the medium to be pumped. More particularly the invention relates to a system for the prevention of the jamming of grease pumps. The system incorporates a housing which is attached to the lower end of a pumping means. The housing contacts and holds down the thin, flexible, liner against the bottom of the container preventing damage to the pumping means from slivers of plastic that could be drawn into the system pump assembly causing serious damage.

BACKGROUND OF THE INVENTION

Lubricating grease is provided to commercial customers in containers of varying sizes depending on the end use of the grease. An example of such container is a five gallon pail which typically holds about 35 pounds of grease. Larger containers include a 16 gallon keg containing 120 pounds of grease and a 55 gallon drum containing 400 pounds of grease. The kegs have been used with automatic grease systems mounted on very large material handling equipment of the type used in mining activities. In such use the keg is mounted on and travels with the piece of equipment. After a predetermined number of cycles of a component requiring lubrication, a grease pump is automatically activated to lubricate the component. Similarly, in manufacturing plants, a number of pieces of equipment can be tied to a drum of grease fitted with an automatically operated system that periodically dispenses grease to that equipment. The advantages of both these types of systems include the elimination of the need for constant tending of the equipment and a reduction in maintenance personnel requirements.

In such grease systems a pump is typically mounted atop the container. The pump has a pickup tube extending into the container to provide a suction point for the grease. The pickup tube terminates a short distance from the bottom of the container. As a consequence there always remains a thin layer of the normally very thick grease that cannot be pumped from the bottom of the container and could be lost as waste. The pump and pickup tube make up a pump assembly that can be moved from container to container as the grease therein is used up. This assembly is usually attached to a flexible discharge line so as to facilitate the change out of the grease containers.

The disposal of empty grease containers containing the residual amount of grease that cannot be reached by the pickup tube has given rise to environmental concerns. The grease can be considered a hazardous waste, making the proper disposal of the spent containers extremely costly and administratively burdensome. Cleaning the containers to a point that they could be disposed as normal, uncontaminated waste would be even more cost prohibitive. These environmental concerns led to the introduction of plastic liners in grease containers. Used in every size of container described above, the liners are a bag or sack that is installed in the container prior to filling. After the container is empty, the plastic liner can be removed from the container taking with it any residual grease. It is then possible to advantageously roll, scrape, or squeeze the residual grease out of the liner and then compact many liners into one container, thereby greatly reducing the amount of hazardous material generated. The liners offer the further advantages of reducing greatly the amount of waste grease from each container and allowing the empty containers to be reused or disposed easily. The liners have gained wide acceptance in the field.

Use of the liners has not come without some problems. The suction force of the grease systems is quite strong. It has been observed that as the grease level falls to close to the bottom of the containers, it is possible for the plastic liner to be drawn up from the bottom of the container and thereby be sucked up into the pickup tube. The slivers of plastic material thus generated cause tremendous damage to the grease pump components, many of which are manufactured to fine tolerances. Correcting the problem requires the time consuming job of disassembling the pump to find and remove the small pieces of plastic liner. It is also possible that pieces of the liner may pass through the pump and cause damage to the equipment being lubricated. The down time associated with these failures can be extremely costly to a high volume manufacturing facility or to a critical piece of mobile material handling equipment. This down time is particularly troublesome for automatic, unattended lubricating systems whose advantage is the elimination of the need for constant attention by maintenance workers. There exists a need then for a device to hold down the plastic liner of a grease container while at the same time allowing unimpeded flow through a grease pump pickup tube.

Attempts to address this kind of problem include U.S. Pat. No. 4,505,138 to Lang. This patent describes a trap for use in a top loading washing machine to prevent articles of clothing from entering the drain pump. The trap is located within the entrance to the hose connection between the tub and the pump.

U.S. Pat. No. 2,300,952, issued to Duthie, discloses a pump foot valve screen mounted in a pan to keep sand and small rocks from being drawn into the pump and causing undue wear and damage.

U.S. Pat. No. 1,945,824 to Saxe discloses a sand strainer for pumps. The strainer is intended to prevent the intake of sand into a pump by lowering the velocity of the incoming water. The construction of the strainer creates a trap that in combination with the low velocity water tends to keep sand out of the water being pumped.

Each of the inventions disclosed above, while useful for preventing the fouling of water pumps, are not acceptable for the pumping of grease or any other material of similar viscosity. The flow of such a material would be greatly impeded by the screens used in the strainers described above. Therefore, there exists a need for a system for use with a lined container that will maximize flow while preventing a plastic liner from being drawn into the pumping means.

SUMMARY OF THE INVENTION

The present invention relates to a system for pumping a medium from a container having a disposable liner including: a pumping means; a cylindrical housing having a central cavity, the housing positioned at a lower end of the pumping means; at least one passage through the wall of the housing; means for securing a top end of the housing to the lower end of the pumping means so that a bottom end of the housing contacts the liner to prevent the liner from being drawn into the pumping means while allowing flow of the medium through said at least one passage upwardly through the central cavity into the pumping means.

The present invention further relates to a system having at least one leg extending downwardly from the bottom end of the housing, the leg being an integral extension of the housing.

The present invention also relates to a system wherein the means for attaching is a clamp, a set screw, or a set of internal or external threads.

The present invention also relates to a system having at least one slot extending downwardly from the top of the housing into the leg, wherein the slot tapers from wide to narrow, from the top of the housing to the bottom of the housing.

Another embodiment of the present invention relates to a system wherein the central cavity tapers from wide to narrow from the top of the housing to the bottom of the housing and the means for securing is a friction fit between the housing and the pumping means.

Yet another embodiment of the present invention relates to a system wherein the legs terminate in a continuous circular ring which contacts and holds down the liner.

DETAILED DESCRIPTION OF THE INVENTION

Figure 1:
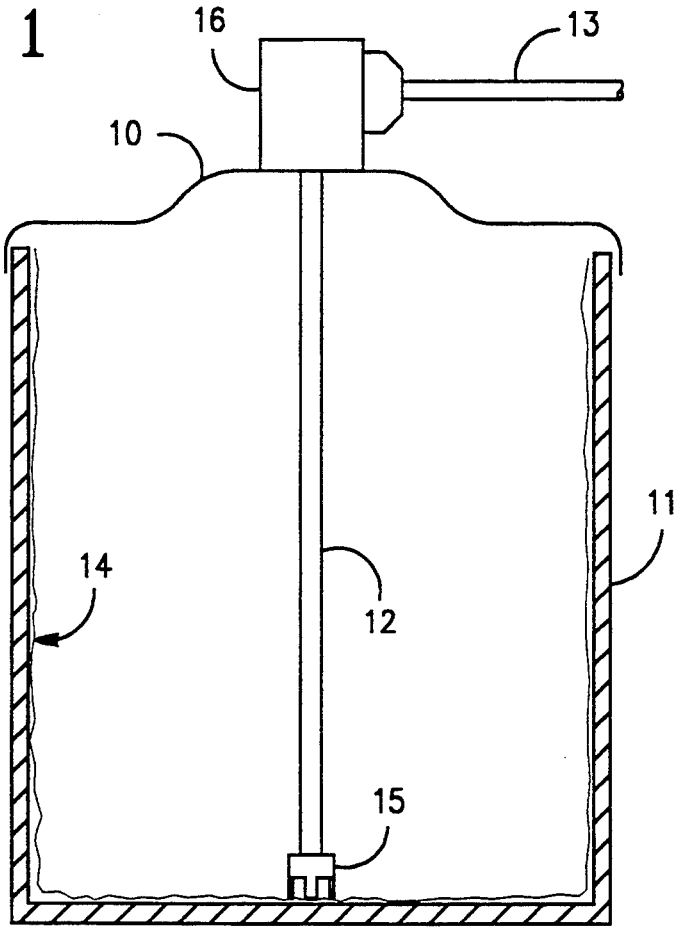
FIG. 1 shows a grease container with a liner and grease pump assembly.

Turning to FIG. 1, a typical grease pump assembly 10 of a type typically installed on a grease container 11 is illustrated. The pump unit 16 is connected to a pick up tube 12 which extends into the grease to be dispensed. Those two components comprise a pumping means. The pump unit 16 discharges through a flexible line 13 to the equipment to be lubricated.

The container 10 is protected by a plastic liner 14 which conforms to the shape of the container as the container is filled. The liner lies substantially flat against and conforms to the shape of the sides and bottom of the container. The hold down device 15 is rigidly attached to the lower end of the pickup tube 12 and is positioned such that it lightly contacts the liner 14. By light contact it is meant that the hold down device 15 touches and holds the liner 14 against the bottom of the container without exerting sufficient force to pierce the liner.

Figure 2:
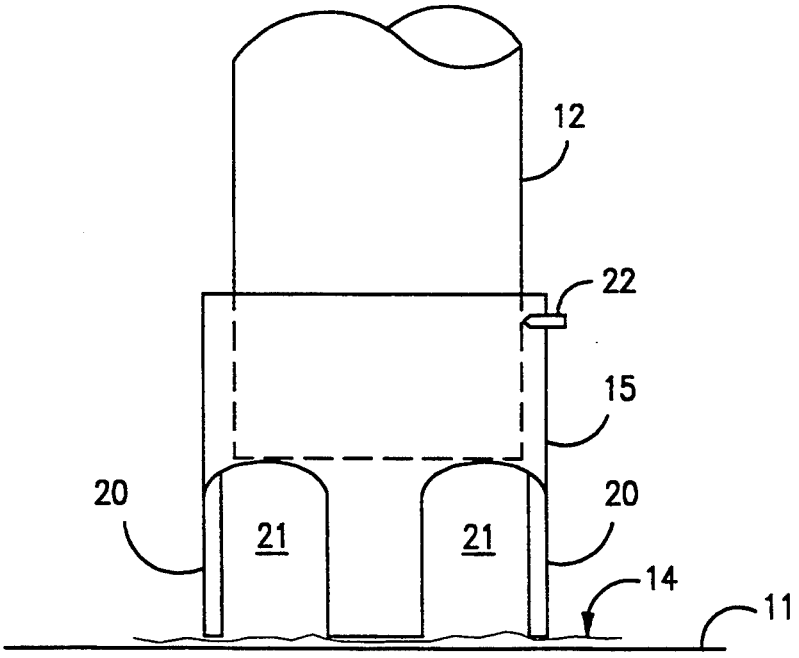
FIG. 2 presents a detail of the hold down device installed on the lower end of a grease pump pick up tube.
Figure 3:
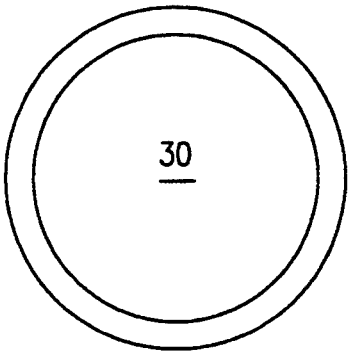
FIG. 3 is an end view of the housing showing the central cavity therein.

Referring now to FIG. 2 which is a detail of the pick up tube 12 inside the container 11, it can be seen that the housing is positioned at the lower end of the tube 12. The hold down device is a cylindrical housing having a top end, a bottom end and a central cavity 30 as shown in FIG. 3 which is a top view of the housing. The diameter of the central cavity 30 should be slightly larger than that of the system pickup tube so that the housing can be easily positioned thereon. The housing should be fabricated from a material having sufficient rigidity to hold the container liner 14 in place against the bottom of the container 11 in the face of the suction forces generated during operation of the system. In a nonlimiting example the housing could be fabricated from any lightweight metal such as aluminum. More preferred is a stiff rubber having the properties just described. Still more preferred is some type of plastic. Particularly preferred among plastics is polyvinyl chloride (PVC) which can be easily formed and machined. The housing of the present invention would be very simple to fabricate using any well known injection molding technique. The housing may more preferably be fabricated from commonly available PVC pipe fittings. These fittings are available in a wide range of sizes so as to accommodate most lubrication systems.

At least one leg 20 extends downwardly from the bottom end of the housing to lightly contact the liner as shown in FIG. 2. The leg is an integral extension of the wall of the housing. It must be sufficiently wide to hold down the liner securely and yet not puncture the container liner when the liner is drawn against the leg by the suction force generated by the pump head 16 pictured in FIG. 1. It has been found that a minimum of one leg must be provided to ensure proper performance of the hold down device. More preferably two legs should be provided to hold the liner down securely. Additional legs can be utilized, however, as the number of legs increases beyond four, the size of the medium passages 21 must decrease to the point that the flow of the medium to be pumped is impeded. The passages 21 of the present invention are defined by the legs 20 extending downwardly from the housing. The number and size of passages 21 in a particular embodiment will vary with the number and size of the legs 20 used. However, any embodiment of the present invention will have a passage large enough to pass all but a relatively large object therethrough.

Figure 4:
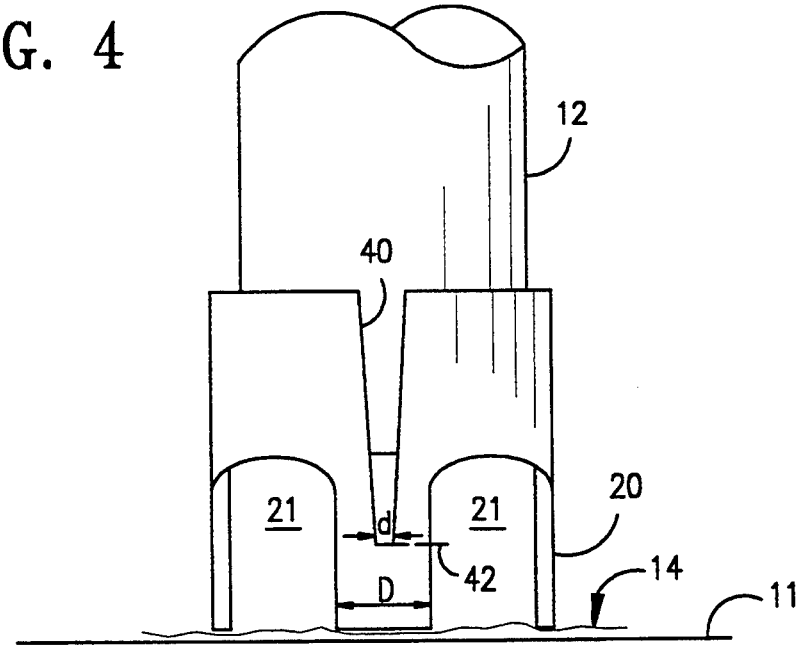
FIG. 4 is an elevation view of the slotted embodiment of the present invention.

Some embodiments of the present invention as typified by FIG. 4 may incorporate tapered slots 40 extending downwardly from the top of the housing into each leg. The slots 40 taper in width from wide to narrow from the top to the bottom of the housing. The length of each slot 40 is defined by the distance from the top of the housing to about the vertical midpoint 42 of the legs. Each slot extends a significant distance into each leg and requires the removal of a not insignificant amount of material from each leg. Accordingly, each leg must have a sufficient width to provide proper functional strength. It has been found that the ratio of width, D, of a leg to the width, d, of the bottom of the slot should be at least 4:1.

Figure 5:
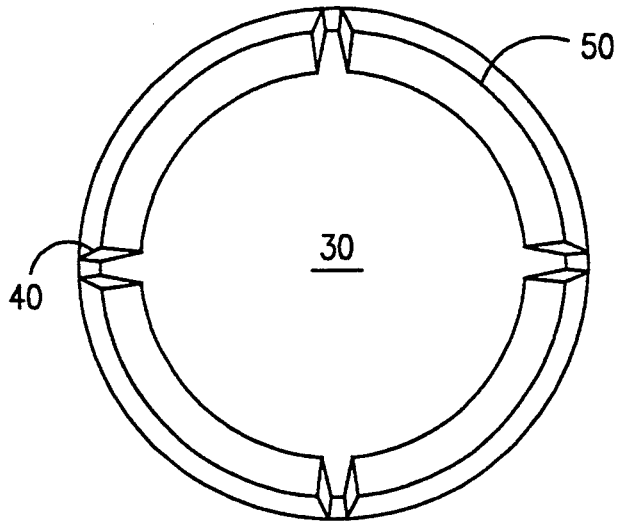
FIG. 5 is an end view of the slotted embodiment of the present invention.

As can be seen from the top view of the slotted embodiment of the housing in FIG. 5, the slots divide the circumference of the housing into a number of sections 50. The number of sections in any embodiment having slots will always match the number of slots and legs used. The slots facilitate a secure attachment of the housing to the pickup tube. As a securing means is tightened around the top of the housing after the housing has been positioned on the pickup tube, the top section of the housing is compressed into secure contact against the pickup tube. In the fully compressed condition each section of the upper part of the housing is drawn toward an adjoining section such that the taper in each slot is collapsed to a straight channel slot having parallel sides. Without the slots, the rigid continuous housing material would resist the compressive force of the securing means and a secure attachment would not result.

Figure 4A:
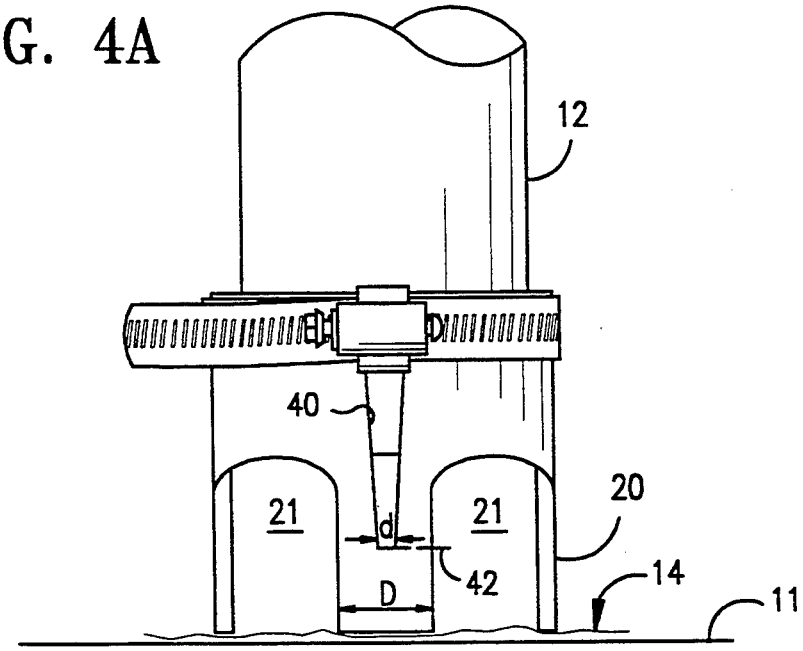
FIG. 4A is an elevation view utilizing a compressive clamp to secure the housing to the pickup tube.

Some means of securing the housing to the pumping means must be provided to ensure that the housing maintains light contact with the container liner 14. A preferred embodiment is shown in FIG. 4A where the housing is rigidly secured to the pick up tube by a compressive clamp. The clamp can be any ordinary type known in the mechanical art. A preferred clamp is the type commonly used for automobile radiator hoses. Such clamps can be adjusted easily and quickly using a screwdriver. Other methods of securing the housing to the pickup tube are described herein below.

To install the system of the present invention, the lower end of the pick up tube 12 is extended through the top end of the housing into the central cavity. The pickup tube should extend into the central cavity to some point just above or in approximate alignment with the top of the passages 21 located in the wall of the housing. It is not desirable to extend the pick-up tube past that point as it would then partially block the passages and restrict the flow of the pumped medium. After positioning the housing on the pick-up tube 12, the securing means is tightened to obtain a loose fit thereon. By a loose fit it is meant a fit tight enough so that the housing will not slide off the pick-up tube 12. However, the fit is loose enough that the housing can be moved up and down on the pick-up tube 12 with the human hand. The entire pump assembly 16 is then carefully lowered into an empty container having a liner therein. As the pump assembly reaches its final position atop the container, the legs 20 will come into light contact with the liner and the housing 15 will move up along the pick-up tube into the proper position. The housing 15 will remain in the proper position due to the loose fit. The pump assembly* with the housing properly positioned thereon is then removed from the container so that the securing means can be adjusted for a tight fit. The pump assembly can then be used repeatedly in containers of the same height without need for further adjustment. The present invention can be advantageously adapted to containers of different sizes by repeating the adjustment process just described.

Another advantage of the system of the present invention is the wide range of flexibility with respect to the configurations and methods used to secure the housing to the pumping means. In the embodiment shown in FIG. 2 the securing means is a set screw. This embodiment does not require or utilize the tapered slots shown in FIG. 4, however, the legs, passages and method of installation are identical to those described herein above.

Figure 6:
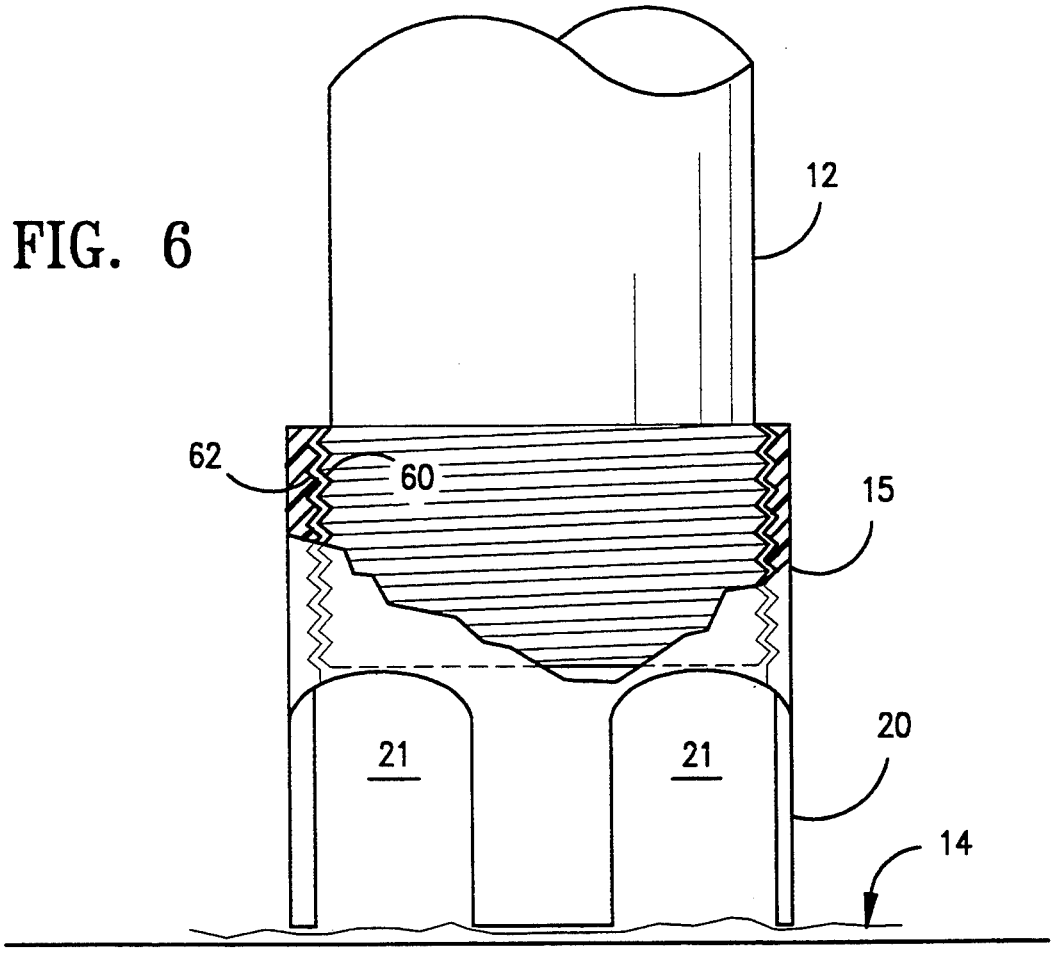
FIG. 6 is an elevation of the present invention utilizing external threads on the pump assembly pickup tube.

FIG. 6 illustrates the use of external threads 60 on the pickup tube as a means for securing the housing thereon. In this embodiment the housing is provided with a matching set of threads 62 on the inside wall of the housing 15 so that the housing 15 can be screwed onto the pickup tube 12. The installation procedure for this embodiment requires that physical measurements be taken of the container 11 to approximately locate the housing 15 on the pickup tube 12. Minor height adjustments would then be necessary to precisely position the housing 15. The threads used for this method of securing must be fine enough to permit minute adjustments to housing position and thus ensure light contact with the container liner. Though not shown in FIG. 6, it is possible to use a set screw with this embodiment to obtain an even more secure attachment of the housing* to the pickup tube*.

Figure 7:
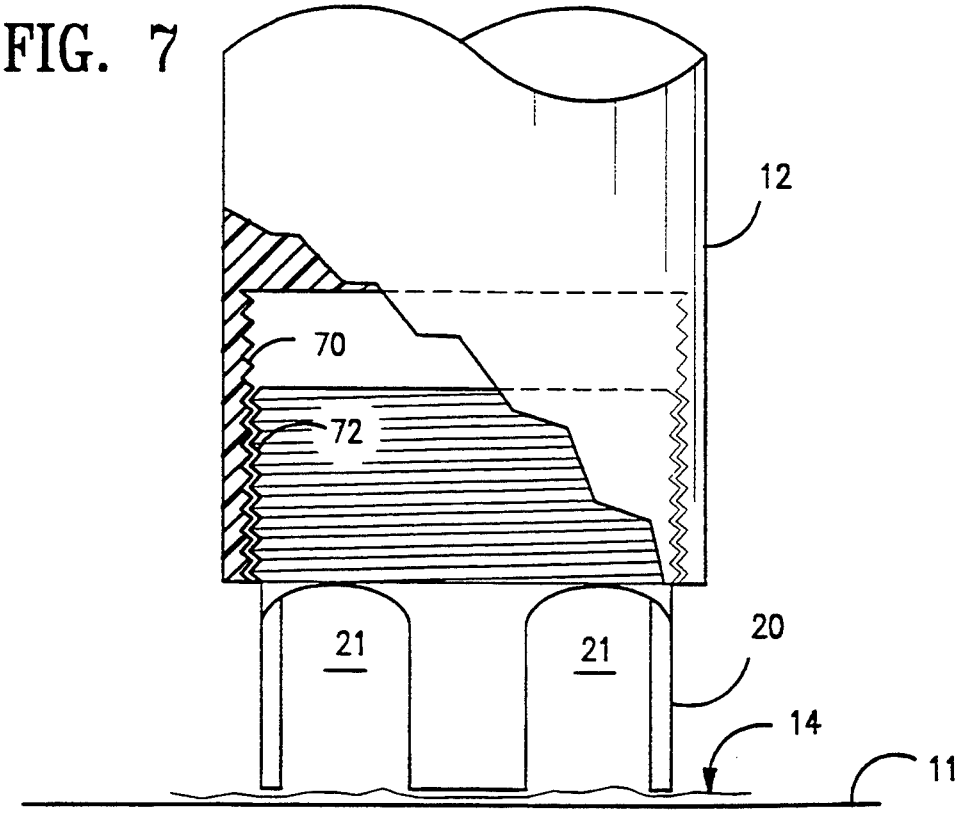
FIG. 7 is an elevation of the present invention showing internal threads on the pump assembly pickup tube.

Internal pickup tube threads 70 are utilized in the embodiment of FIG. 7. The housing of this embodiment has external threads 72 on the outside wall of the housing. Installation and adjustment of this embodiment mirrors that of the external thread embodiment.

Figure 8:
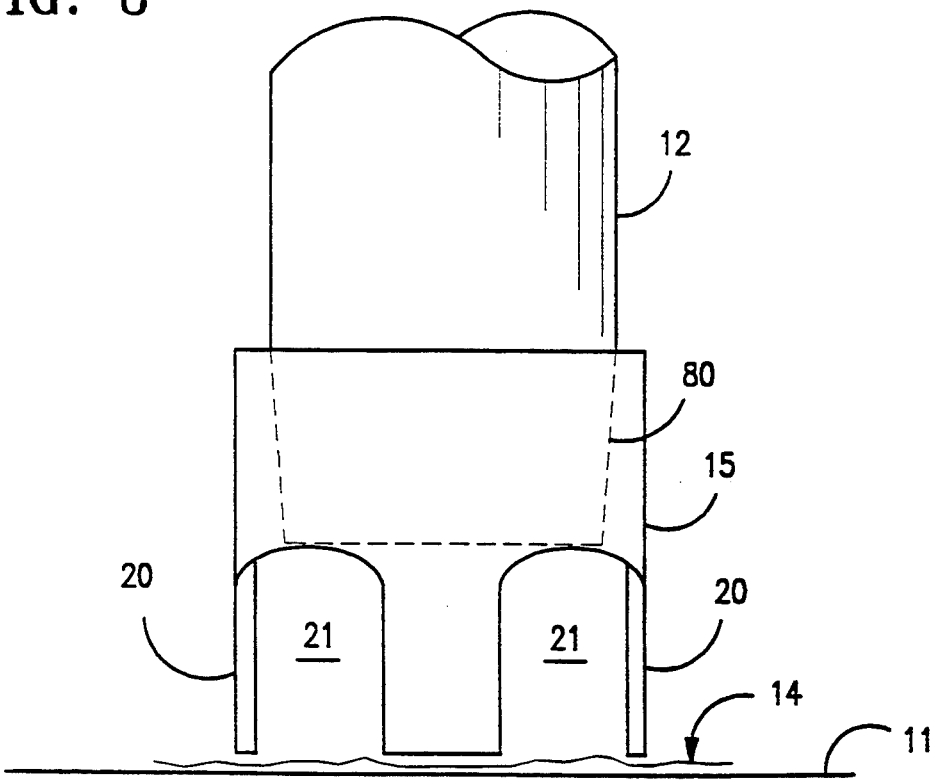
FIG. 8 is an elevation of the present invention utilizing a tapered central cavity as a means to secure the housing to the pickup tube.

Another possible embodiment is shown in FIG. 8 wherein the housing central cavity 30 tapers from wide to narrow, from the top to the bottom of the housing. The housing is then pushed onto the pickup tube 12 and held securely by a friction fit between the tapered central cavity 80 and the constant diameter pickup tube 12. While this embodiment of the present invention is fully operative to hold down the container liner, it does not offer the flexibility to be used in varying sized containers.

Figure 9:
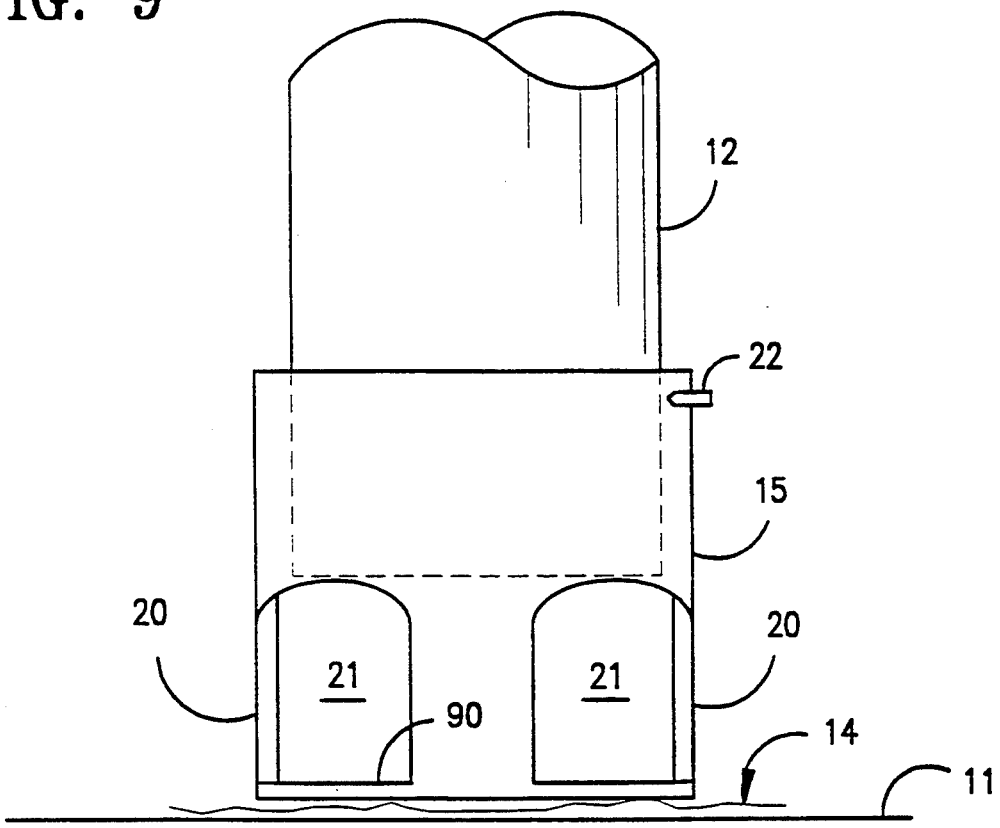
FIG. 9 is an elevation of the present invention wherein the legs terminate in a continuous circular ring which contacts the liner.

FIG. 9 shows an embodiment of the present invention that uses a set screw to secure the housing to the pickup tube. In this embodiment, the legs terminate in a continuous circular ring 90 which contacts the liner. This ring 90 has a low profile so as to minimize the flow restriction to the medium to be pumped.

The present invention can be readily distinguished from a common strainer in many important respects. The housing of the present invention is intended to allow as much of the pumped medium as possible to pass therethrough while holding down a container liner. Accordingly, the passages located in the walls of the housing must be as large as possible consistent with maximizing flow. Any system which would function adequately as a strainer would fail in the function of the present invention. A strainer is designed to trap foreign particles. Inherent in the use of a strainer in any system is the potential for foreign objects of some size to be present. Any embodiment of the present invention would pass through the kind of object that a strainer is typically designed to capture.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. A system for pumping a medium from a container having a disposable liner comprising:

(a) a container;

(b) a disposable liner disposed within said container;

(c) a pumping means;

(d) a cylindrical housing having a central cavity, said housing positioned at a lower end of said pumping means;

(e) at least one passage through said housing;

(f) means for securing a top end of said housing to said lower end of said pumping means so that a bottom end of said housing contacts said liner to prevent said liner from being drawn into said pumping means while allowing flow through said at least one passage of said medium upwardly through said central cavity into said pumping means.

2. The system of claim 1 further comprising at least one leg extending downwardly from said bottom end of said housing, said leg being an integral extension of said housing.

3. The system of claim 1, wherein said means for securing is a clamp.

4. The system of claim 1 wherein said means of securing is a set screw.

5. The system of claim 1 wherein said means for securing is a set of internal threads.

6. The system of claim 1 wherein said means for securing is a set of external threads.

7. The system of claim 1 wherein said central cavity tapers from wide to narrow from the top of said housing to the bottom of said housing.

8. The system of claim 7 wherein said means for securing is a friction fit between said housing and said pumping means.

9. A system for pumping a medium from a container having a disposable liner comprising:

(a) a container;

(b) a disposable liner disposed within said container;

(c) a pumping means;

(d) a cylindrical housing having a central cavity, said housing positioned at a lower end of said pumping means;

(e) at least one leg extending downwardly from a bottom end of said housing, said leg being an integral extension of said housing;

(f) at least one passage defined by said at least one leg;

(g) at least one slot extending downwardly from a top of said housing into said leg, wherein said slot tapers from wide to narrow, from said top of said housing to the bottom of said housing;

(h) means for securing a top end of said housing to said lower end of said pumping means so that said bottom end of said housing contacts said liner to prevent said liner from being drawn into said pumping means while allowing flow through said at least one passage of said medium upwardly through said central cavity into said pumping means.

* * * * *